United States Patent [19]

Skaugen

[11] Patent Number: 4,793,899

[45] Date of Patent: Dec. 27, 1988

[54] COATING PRESS APPARATUS USING SHORT DWELL COATERS

[75] Inventor: Borgeir Skaugen, Beloit, Wis.

[73] Assignee: Beloit Corporation, Beloit, Wis.

[21] Appl. No.: 76,828

[22] Filed: Jul. 23, 1987

[51] Int. Cl.[4] ..... D21D 3/00

[52] U.S. Cl. ..... 162/381; 118/261; 162/184; 162/360.1

[58] Field of Search ..... 162/135, 184–186, 162/360.1, 381; 118/203, 259, 261; 427/209, 211, 365

[56] References Cited

U.S. PATENT DOCUMENTS

| | | | |
|---|---|---|---|
| 2,398,843 | 4/1946 | Muggleton et al. | 118/203 |
| 2,398,844 | 4/1946 | Muggleton et al. | 118/203 |
| 2,772,604 | 12/1956 | Muggleton | 162/184 |
| 3,146,159 | 8/1964 | Muggleton | 162/184 |
| 3,518,964 | 7/1970 | Nagler | 118/126 |
| 4,257,844 | 3/1981 | Schmitt et al. | 162/360.1 |
| 4,357,370 | 11/1982 | Alheid | 118/261 |
| 4,548,840 | 10/1985 | States et al. | 118/261 |

FOREIGN PATENT DOCUMENTS

| | | | |
|---|---|---|---|
| 16315 | of 1897 | United Kingdom | 162/184 |

*Primary Examiner*—David L. Lacey

*Assistant Examiner*—K. M. Hasting

*Attorney, Agent, or Firm*—Dirk J. Veneman; Raymond W. Campbell; David J. Archer

[57] ABSTRACT

A coating press apparatus is disclosed for coating a first and second side of a pressed web formed in a forming section of a papermaking machine. The apparatus includes a first press roll which defines a smooth imperforate first surface. The first surface cooperates with the first side of the web. A first backing roll cooperates with the first press roll for defining therebetween a first nip for the passage therethrough of the web. A first felt supports the web during passage through the first nip and a first short-dwell coater applies a coating directly to the surface of the first press roll upstream relative to the first nip such that a smooth and even first layer of the coating substance is applied to the first side of the web during passage of the web through the first nip. A second short-well coater is disposed downstream relative to the first nip for applying a smooth and even second layer of coating substance to the second side of the web such that the first and second sides of the resultant pressed web exhibit a higher coating content than the coating content betwen the first and the second sides thereby enhancing the surface properties and resulting printability of the web.

5 Claims, 2 Drawing Sheets

COATING PRESS APPARATUS USING SHORT DWELL COATERS

BACKGROUND OF THE INVENTION

1. Field of the Invention

This invention relates to a coating press apparatus for coating a first and second side of a press web formed in a forming section of a papermaking machine. More specifically, this invention relates to a coating press apparatus for applying a coating onto the respective sides of a paper web.

2. Information Disclosure Statement

In the past, printed flyers and the like have been printed on lightweight coated papers. However, due to the relatively high cost of providing coaters for coating a dried, or semi-dried, paper web and further because of the cost of the coating material, various proposals have been set forth in an attempt to provide a low cost, paper or board having surface characteristics suitable for printing thereon.

In the prior art, clay has been added in the headbox in order to enhance the printability of the resultant web. However, when clay, or other mineral additives, are included in the headbox, there exists a tendency for these fines to become less dense towards the respective surfaces of the web during web formation. Therefore, the additive content is relatively high at the middle of the web thickness (or caliper) where the coating substance is not required whereas the amount of coating substance present at the surface to be printed is relatively small.

In an attempt to increase the coating, or ash, content which is normally in the order of 9% to a satisfactory printing content of 20%, it has been found necessary to increase the quantity of clay, talc, calcium carbonate or the like added to the headbox to approximately 50% of the solids content of the stock. From the foregoing, it is apparent that much of the additive added is lost during the dewatering process and the production of a 20% ash content paper is relatively costly.

In an attempt to enhance the application of a coating substance to the respective surfaces of the web, U.S. Pat. No. 3,146,159 to Muggleton and assigned to Combined Locks Paper Company, teaches the application of a layer of clay to the press roll such that this layer is transferred to the formed web.

Although the aforementioned proposal of U.S. Pat. No. 3,146,159 reduces the amount of clay required to produce a printable web, problems have been experienced in the application of the layer of clay at high speeds. U.S. Pat. No. 3,146,159 discloses a method involving applying the layer of clay by an applicator roll initially rotating at the same speed as the press roll but as the press roll increases in rotational speed, the speed of the applicator roll is reduced relative to the speed of the press roll thereby avoiding splashing of the applied coating. Whereas the aforementioned proposal is relatively successful with production speeds of 1000 fpm, serious problems have been experienced when attempting to apply a coating, or clay layer, at current speeds which approach 4000 or more fpm.

The present invention seeks to overcome the aforementioned problem by providing a short-dwell coater for applying a layer of coating substance directly to a smooth surface of a press roll such that the layer is transferred during passage of the pressed web through a first nip defined by the press roll and a first backing roll.

The present invention applies the first layer of coating substance to the web that has previously passed through an upstream press nip. Therefore, the present invention provides a coating press apparatus that overcomes the aforementioned inadequacies of the prior art proposals and provides a coating press which makes a significant contribution to the papermaking art.

Another object of the present invention is the provision of a coating press apparatus in which a first short-dwell coater applies a coating substance directly to a smooth imperforate surface of a first press roll upstream relative to a first nip defined by the first press roll and a first backing roll.

Another object of the present invention is the provision of a coating apparatus in which a second short-dwell coater is disposed downstream relative to the first nip for applying a smooth and even second layer of a coating substance to the second side of the web so that the web exhibits a higher coating content at the first and second side surfaces thereof than the coating content between the first and second sides thereby enhancing the printability of the resultant web.

Another object of the present invention is the provision of a coating press which includes a second press roll and a second backing roll defining therebetween a second nip for the passage therebetween of a first felt and the web. The second nip is disposed upstream relative to the first nip and a second felt extends through the second nip such that the web is disposed between the first and second felts during passage through the second nip.

Another object of the present invention is the provision of a coating press apparatus in which the first short-dwell coater includes a doctor which is disposed upstream relative to the first nip for cleaning the imperforate first surface prior to the coating of the surface with the first layer. The first short-dwell coater also includes an applicator which is disposed between the doctor and the first nip for applying the first layer to the imperforate surface. Additionally, the first short-dwell coater includes a metering blade or rod which is disposed between the applicator and the first nip for smoothing the first layer before the first layer is brought into physical contact with the first side of the web.

Another object of the present invention is the provision of a coating press apparatus which includes a third backing roll which is disposed downstream relative to the first nip, the third backing roll cooperating with the first press roll such that a third nip is defined between the third backing roll and the first press roll so that the web is pressed during passage through the third nip with the second side of the web facing towards the third backing roll.

Another object of the present invention is the provision of a coating press apparatus which includes a third press roll and a fourth backing roll which cooperates with the third press roll for defining therebetween a fourth nip. A fourth felt extends through the fourth nip with the fourth felt disposed in physical contact with the first side of the web. The second short-dwell coater cooperates with the second surface of the third press roll for applying a second layer of coating substance to the second surface such that the second layer is transferred onto the second side of the web during transit through the fourth nip.

Other objects and advantages of the present invention will be apparent to those skilled in the art by a consideration of the detailed description contained hereinafter taken in conjunction with the annexed drawings.

SUMMARY OF THE INVENTION

This invention relates to a coating press apparatus and method for coating a first and second side of a pressed web formed in a forming section of a papermaking machine. The apparatus includes a first press roll which defines a smooth imperforate first surface. The first surface cooperates wihh the first side of the web and a first backing roll cooperates with the first press roll for defining therebetween a first nip for the passage therethrough of the web. A first felt supports the web during passage through the first nip and a first short-dwell coater applies a coating directly to the surface of the first press roll upstream relative to the first nip. The arrangement is such that a smooth and even first layer of coating substance is applied to the first side of the web during the passage of the web through the first nip. Also, a second short-dwell coater is disposed downstream relative to the first nip for applying a smooth and even second layer of coating substance to the second side of the web such that the first and second sides of the resultant pressed web exhibit a higher coating content than the coating content between the first and second sides thereby enhancing the printability of the resultant web.

In a more specific embodiment of the present invention, the first press roll is a rotatable plain roll having a diameter which is greater than the diameter of the first backing roll and the backing roll is a vented roll. The first felt is disposed in physical contact with the second side of the web such that when the first felt and the web extend through the first nip, the first side of the web is pressed into physical contact with the first layer of coating substance so that the first layer of coating substance is transferred to the first side of the web.

More specifically, the coating press includes a second press roll which is dipposed upstream relative to the first nip with the first felt extending around the second press roll. A second backing roll cooperates with the second press roll such that the second press roll and second backing roll define therebetween a second nip for the passage therebetween of the first felt and the web. A second felt extends through the second nip such that the web is disposed between the first and the second felt during passage through the second nip.

The first short-dwell coater also includes a doctor which is disposed upstream relative to the first nip for cleaning the imperforate first surface prior to the coating of the first surface with the first layer. An applicator is disposed between the doctor and the first nip for applying the first layer to the first imperforate surface. A metering blade, or rod, is disposed between the applicator and the first nip for smoothing the first layer before the first layer is brought into physical contact with the first side of the web.

In one embodiment of the present invention, the applicator applies a liquid coating of the coating substance onto the imperforate first surface whereas in another alternative embodiment of the present invention, the applicator applies a spray coating of the coating substance onto the imperforate first surface.

In either embodiment of the present invention, the coating press also includes a third backing roll which is disposed downstream relative to the first nip. The third backing roll cooperates with the first press roll such that a third nip is defined between the third backing roll and the first press roll so that the web is pressed during passage through the third nip with the second side of the web facing towards the third backing roll.

A third felt extends through the third nip such that the third felt is disposed in physical contact with the second side of the web for further pressing the first layer against the first side of the web.

A third press roll defines a smooth imperforate second surface which cooperate with the second side of the web. A fourth backing roll cooperates with the third press roll for defining therebetween a fourth nip. A fourth felt extends through the fourth nip with the fourth felt being disposed in physical contact with the first side of the web. A second short-dwell coater cooperates with the second surface for applying the second layer onto the second surface such that the second layer is transferred onto the second side of the web during transit through the fourth nip.

The present invention also includes a method for coating a first and second side of a pressed web formed in a forming section of a papermaking machine. The method includes the steps of doctoring a first smooth imperforate surface of a first press roll for cleaning the first surface. A first layer of coating substance is applied directly to the cleaned first surface of the first press roll and the first layer is metered for smoothing the first layer over the first surface of the first press roll. The web is passed through a first nip defined by the first press roll and a first backing roll such that the first side of the web is preseed into physical contact with the first layer so that the first layer is transferred onto the first side of the web. A second layer of coating substance is applie by means of a short-dwell coater disposed downstream relative to the first nip. The second layer is applied to a second smooth imperforate surface of a further press roll such that the second layer is brought into physical contact with the second side of the web during passage of the web through a further nip defined by the further press roll and a further backing roll.

Although the preferred embodiment of the present invention is described with certain particularity in the following detailed description and in the annexed drawings, it will be understood by those skilled in the art that many modifications and variations of the present invention may be made without departing from the spirit and scope of the present invention as defined by the appended claims.

Although the present invention is particularly suitable for the application of clay to the respective surfaces of the web, the present invention also envisages the application of talc, sizing, calcium carbonate or the like. Additionally, the present invention includes application to one side only of the web. The present invention also includes application of a press coating which can be used to enhance release characteristics of a man-made press roll cover as a replacement for a granite roll. In such application, the release agent could be a surfactant or the like. Although in the preferred embodiment of the present invention as described hereinafter, a tri-nip press and a fourth press are used, the present invention includes a two-press arrangement.

DETAILED DESCRIPTION OF THE DRAWINGS

Figure 1:
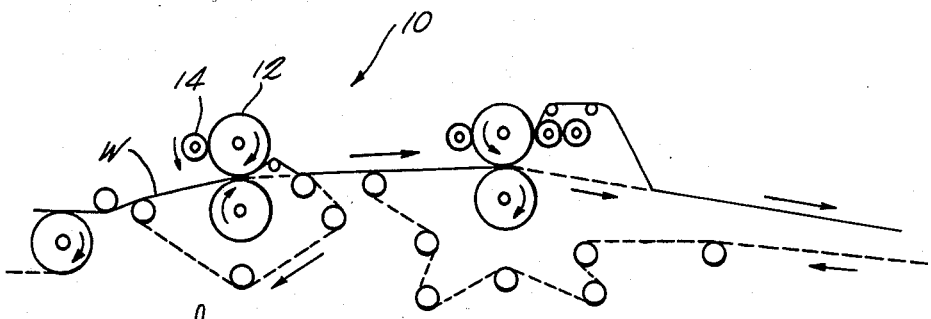
Fig. 1 PRIOR ART
FIG. 1 is a side-elevational view of a prior art coating press apparatus showing the coating being applied by means of a coater roll.

FIG. 1 is an elevational view of a prior art coating apparatus generally designated 10 as disclosed in U.S. Pat. No. 3,146,159. The coating press apparatus 10 includes a press roll 12 and a rotatable applicator roll 14 for applying a coating to one side of the web W.

Figure 2:
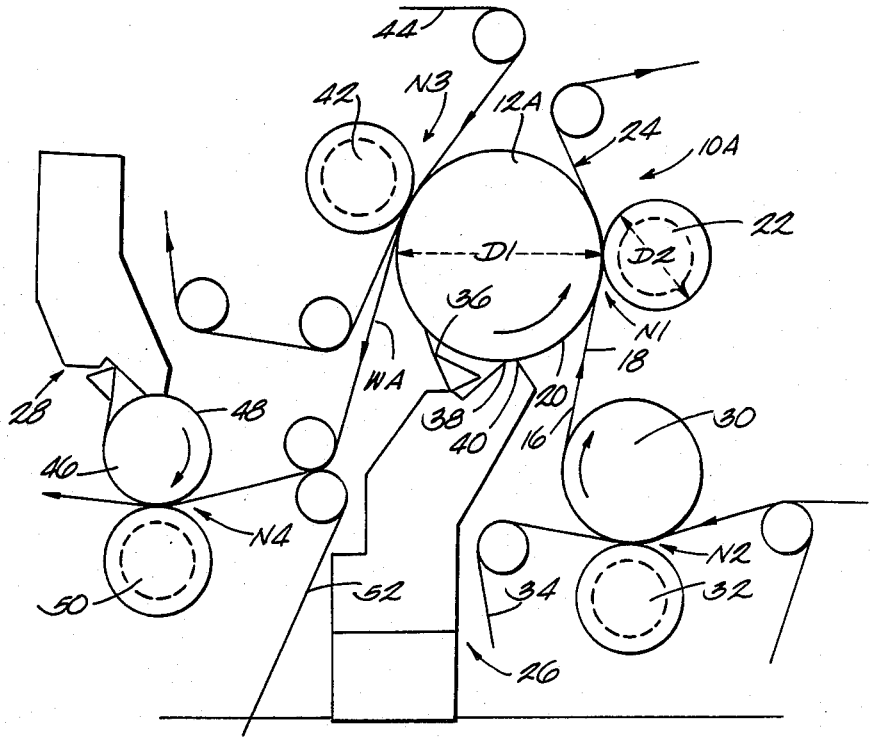
FIG. 2 is a side-elevational view of the coating press apparatus according to the present invention showing a first and second short-dwell coater.

Problems have been experienced with the prior art proposal when operating at speeds above 1000 fpm. The proposal, as shown in FIG. 2, according to the present invention, overcomes the aforementioned problems of splashing by the provision of short-dwell coaters. More specifically, as shown in FIG. 2, a coating press apparatus 10A coats a first and second side 16 and 18 respectively of a pressed web WA formed in a forming section of a papermaking machine. The apparatus 10A includes a first press roll 12A which defines a smooth imperforate first surface 20 such that the first surface 20 cooperates with the first side 16 of the web WA. A first backing roll 22 cooperates with the first press roll 12A for defining therebetween a first nip N1 for the passage therethrough of the web WA. A first felt 24 supports the web WA during passage through the first nip N1 and a first short-dwell coater generally designated 26 applies coating substance directly to the surface 20 of the first press roll 12A upstream relative to the first nip N1 such that a smooth and even first layer of coating substance is applied to the first side 16 of the web WA during passage through the first nip N1. A second short-dwell coater generally designated 28 is disposed downstream relative to the first nip N1 for applying a smooth and even second layer of coating substance to the second side 18 of the web WA such that the first and second sides 16 and 18 respectively of the resultant pressed web WA exhibit a higher coating content than the coating content between the first and second sides 16 and 18 thereby enhancing the printability of the resultant web WA.

As shown in FIG. 2, the first press roll 12A is a rotatable plain roll having a first diameter D1 which is greater than the diameter D2 of the first backing, or press, roll 22. Furthermore, the first backing roll 22 is a vented roll.

The first felt 24 is disposed in physical contact with the second side 18 of the web WA such that when the first felt 24 and the web WA extend through the first nip N1, the first side 16 of the web WA is pressed into physical contact with the first layer of coating substance so that the first layer of coating substance is transferred to the first side 16 of the web WA.

The apparatus 10A also includes a second press roll 30 which is disposed upstream relative to the first nip N1 with the first felt 24 extending around the second press roll 30. A second backing roll 32 cooperates with the second press roll 30 such that the second press roll 30 and the second backing roll 32 define therebetween a second nip N2 for the passage therebetween of the first felt 24 and the web WA. A second felt 34 extends through the second nip N2 such that the web WA is disposed between the first and second felts 24 and 34 respectively during passage through the second nip N2.

Figure 3:
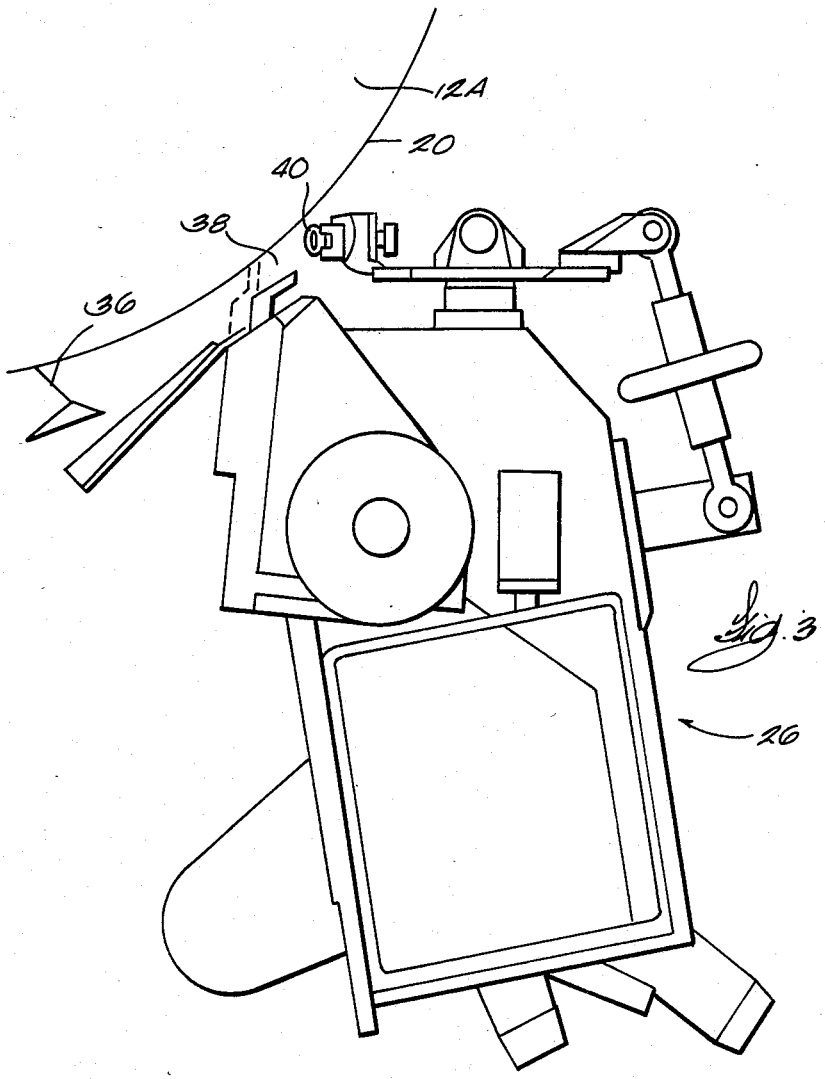
FIG. 3 is an enlarged elevational view of the first short-dwell coater.

The first short-dwell coater 26 also includes a doctor 36 which is disposed upstream relative to the first nip N1 for cleaning the imperforate first surface 20 prior to the coating of the first surface 20 with the first layer. An applicator 38 is disposed between the doctor 36 and the first nip N1 for applying the first layer to the first imperforate surface 20. A metering blade or rod 40 as shown more particularly in FIG. 3 is disposed between the first applicator 38 and the first nip N1 for smoothing the first layer before the first layer is brought into physical contact with the first side 16 of the web WA.

In one embodiment of the present invention, the applicator 38 applies a liquid coating substance to the imperforate first surface 20 whereas in an alternative embodiment of the present invention the applicator 38 applies a spray coating of the coating substance to the imperforate first surface 20.

In either embodiment of the present invention, the coating press apparatus 10A also includes a third backing roll 42 which is disposed downstream relative to the first nip N1. The third backing roll 42 cooperates with the first press roll 12A such that a third nip N3 is defined between the third backing roll 42 and the first press roll 12A so that the web WA is pressed during passage through the third nip N3 with the second side 18 of the web WA facing towards the third backing roll 42.

A third felt 44 extends through the third nip N3 such that the third felt 44 is disposed in physical contact with the second side 18 of the web WA for further pressing the first layer against the first side 16 of the web WA.

The coating press apparatus 10A also includes a third press roll 46 which defines a smooth imperforate second surface 48. The second surface 48 cooperates with the second side 18 of the web WA. A fourth backing roll 50 cooperates with the third press roll 46 for defining therebetween, a fourth nip N4. A fourth felt 52 extends through the fourth nip N4 with the fourth felt 52 disposed in physical contact with the first side 16 of the web WA. The second short-dwell coater 28 cooperates with the sccond surface 48 for applying the second layer onto the second surface 48 such that the second layer is transferred onto the second side 18 of the web WA during transit through the fourth nip N4.

Figure 4:
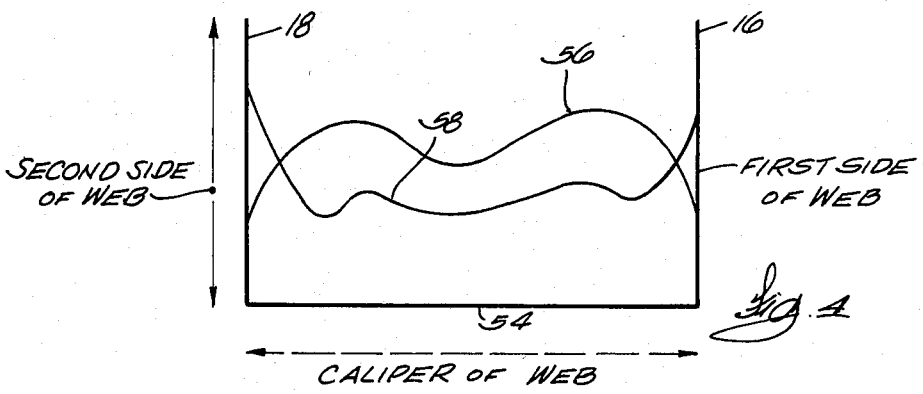
FIG. 4 is a graph showing the amount of clay retained by a web when the clay is added to the headbox as compared to the amount of clay retained according to the present invention.

FIG. 4 is a graphical cross-section of a web showing the first and second sides 16 and 18 thereof with the caliper thereof 54 shown as the distance between the sides 16 and 18 respectively. Graph 56 shows a typical prior art web in which clay has been added at the headbox and the resultant clay content at the sides 16 and 18 is less than between the sides 16 and 18. However, graph 58 shows the clay content higher at the sides 16 and 18 as a result of applying the clay by means of the apparatus of the present invention.

In operation of the apparatus according to the present invention, the coating substance is applied to the first and second sides 16 and 18 respectively of the pressed web WA formed in a forming section of a papermaking machine. This coating operation includes doctoring the first smooth imperforate surface 20 of the first press roll 12A for cleaning the first surface 20. A first layer of coating substance is applied directly to the cleaned first surface 20 of the press roll 12A. The first layer is metered for smoothing the first layer over the first surface 20 of the first press roll 12A. The web WA is passed through the first nip N1 defined by the first press roll 12A and the first backing roll 22 such that the first side 16 of the web WA is pressed into physical contact with the first layer so that the first layer is transferred onto the first side 16 of the web WA. A second layer of coating substance is applied by means of the short-dwell coater 28 disposed downstream relative to the first nip N1. The second layer is applied to the second smooth imperforate surface 48 of the further press roll 46 such that the second layer is brought into physical contact with the second side 18 of the web WA during passage of the web WA through the further nip N4 defined by the further press roll 46 and the further backing roll 50.

The present invention provides a compact coating prsss apparatus for applying a coating substance to the printable surfaces of the formed web without the need for adding fillers at the headbox. Therefore, the present invention not only reduces loss of coating substance during dewatering, but also assures that the coating is applied to the surfaces of the web where it is needed to enhance printability. Also, the present invention enables the production of such printable web at high speeds without the need for any subsequent coating operation or the like.

What is claimed is:

1. A coating press apparatus for coating a first and second side of a pressed web formed in a forming section of a papermaking machine, said apparatus comprising:

a first press roll defining a smooth imperforate first surface, said surface cooperating with the first side of the web;

a first backing roll cooperating with said first press roll for defining therebetween a first nip for the passage therethrough of the web;

a first felt for supporting the web during passage through said first nip;

a first short-dwell coater for applying a coating substance directly to said surface of said first press roll upstream relative to said first nip such that a smooth and even first layer of said coating substance is applied to said first side of the web during said passage through said first nip;

said first short-dwell coater including: a doctor disposed upstream relative to said first nip for cleaning said imperforate first surface prior to the coating of said first surface with said first layer;

an applicator disposed between said doctor and said first nip for applying said first layer to said first imperforate surface;

a metering blade disposed between said applicator and said first nip for smoothing said first layer before said first layer is brought into physical contact with the first side of the web;

a second short-dwell coater disposed downstream relative to said first nip for applying a smooth and even second layer of coating substance to said second side of the web such that the first and second sides of the resultant pressed web exhibit a higher coating content than the coating content between the first and the second sides thereby enhancing the printability of the resultant web;

said coating press further including:

a second press roll disposed upstream relative to said first nip, said first felt extending around said second press roll;

a second backing roll cooperating with said second press roll such that said second press roll and second backing roll define therebetween a second nip for the passage therebetween of said first felt and the web; and a second felt extending through said second nip such that the web is disposed between said first and second felt during passage through said second nip; a third backing roll disposed downstream relative to said first nip, said third backing roll cooperating with said first press roll such that a third nip is defined between said third nip backing roll and said first press roll so that the web is pressed during passage through said third nip with the second side of the web facing towards said third backing roll;

a third felt extending through said third nip such that said third felt is disposed in physical contact with the second side of the web for further pressing said first layer against the first side of the web; and said second short dwell coater being disposed downstream relative to said third nip.

2. A coating press as set forth in claim 1 wherein said first press roll is a rotatable plain roll having a diameter which is greater than the diameter of said first backing roll.

3. A coating press as set forth in claim 1 wherein said first backing roll is a vented roll.

4. A coating press as set forth in claim 1 wherein said first felt is disposed in physical contact with the second side of the web such that when said first felt and the web extend through said first nip, the first side of the web is pressed into physical contact with said first layer of coating substance so that said first layer is transferred to the first side of the web.

5. A coating press as set forth in claim 1 further including:

a third press roll defining a smooth imperforate second surface, said second surface cooperating with the second side of the web;

a fourth backing roll cooperating with said third press roll for defining therebetween a fourth nip;

a fourth felt extending through said fourth nip, said fourth felt disposed in physical contact with the first side of the web;

said second short-dwell coater cooperating with said second surface for applying said second layer onto said second surface such that said second layer is transferred onto the second side of the web during transit through said fourth nip.

* * * * *